United States Patent [19]

Byler et al.

[11] Patent Number: 4,990,226

[45] Date of Patent: Feb. 5, 1991

[54] ELECTROPLATING WIRES WITH NICKEL AT HIGH-SPEED AND A NICKEL FLUOBORATE BATH THEREFOR

[75] Inventors: Tom E. Byler, Pittsfield; Kimberly J. Suchar, Waterford, both of Pa.

[73] Assignee: GTE Products Corporation, Stamford, Conn.

[21] Appl. No.: 431,809

[22] Filed: Nov. 6, 1989

[51] Int. Cl.[5] ..... C25D 3/12; C25D 7/06

[52] U.S. Cl. ..... 204/28; 204/49

[58] Field of Search ..... 204/49, 28

[56] References Cited

U.S. PATENT DOCUMENTS 2,648,628 8/1953 Brown ..... 204/49

3,661,731 5/1972 Schevey ..... 204/49

OTHER PUBLICATIONS

W. A. Wesley et al., 36th Annual Proceed. AM. Electroplaters' Soc., Reprint, (1949).

*Primary Examiner*—G. L. Kaplan

*Attorney, Agent, or Firm*—Elizabeth A. Levy

[57] ABSTRACT

A bath for electrodeposition of nickel onto a steel wire substrate from a nickel fluoborate solution. The bath is pumped to a substantial pressure in a specialized high speed, high current density continuous wire plating cell. The bath has a high concentration of nickel ions and a low pH and is operated at very high current densities and elevated temperatures to achieve a good quality nickel plate deposition at a rate far exceeding that of prior art baths. The invention particularly applies to the plating of nickel onto steel wire at current densities of up to 14,500 amps per square foot.

8 Claims, No Drawings

ELECTROPLATING WIRES WITH NICKEL AT HIGH-SPEED AND A NICKEL FLUOBORATE BATH THEREFOR

CROSS-REFERENCES TO RELATED APPLICATIONS

Information pertinent to this application is described and claimed in U.S. patent application Ser. No. 07/431,798, filed concurrently with this application and assigned to the assignee of the instant invention.

TECHNICAL FIELD

The invention relates to the electrodeposition of nickel from aqueous acidic nickel plating baths and particularly to bath compositions suitable for use at high current densities in high agitation electroplating systems.

BACKGROUND ART

Nickel fluoborate baths are known. See, e.g., U.S. Pat. Nos. 3,898,138, 4,082,621 and 4,244,790. The prior art baths and the operating conditions disclosed therein provide only for very long plating times at relatively low current densities of 10 to 75 amps per square foot (ASF), temperatures of from about 24 to 60 degrees Centigrade, and a pH range of about 2.8 to 6. U.S. Pat. No. 4,082,621, e.g., discloses a plating time of 10 minutes for a plating thickness of 0.0008 inches. These parameters provide for a relatively slow, expensive plating process.

SUMMARY OF THE INVENTION

It is, therefore, an object of the invention to obviate the disadvantages of the prior art.

It is another object of the invention to enhance plating baths.

Yet another object of the invention is the provision of a plating bath allowing increased plating speed.

These objects are accomplished, in one aspect of the invention, by a bath for the electrodeposition of ductile nickel plate onto a wire substrate. The bath comprises an aqueous acidic nickel plating soloution consisting essentially of nickel fluoborate and boric acid, which is used in a high speed continuous wire plating cell at a current density of at least 200 amps per square foot.

BEST MODE FOR CARRYING OUT THE INVENTION

For better understanding of the present invention, together with other and further objects, advantages and capabilities thereof, reference is made to the following disclosure and appended claims.

The superior performance of the bath resides in its high concentration of nickel ions, its low pH, its high operating temperatures and its use in a specialized high current density continuous wire plating cell (see the above-mentioned concurrently filed application, the teachings of which are hereby incorporated by reference). The concentration of nickel ions in the bath is more than double that of prior art baths. Pumping the soloution to achieve a minimum pressure of 50 lbs/in$^2$ within the plating cell ensures a sufficient supply of nickel ions at the cathode for plating at extremely high current densities, for example, at least 10,000 amps per square foot. Higher operating temperatures and lower pH values than in prior art baths enhance the superior performance of the bath. When used with the above-mentioned wire plating cell, electrodeposition of nickel is achieved at current densities far exceeding those possible in prior art baths. Use of this bath as a plating solution greatly reduces the plating time and thus increases plating speed and throughput.

The bath consists essentially of nickel fluoborate and boric acid. The concentration of nickel fluoborate is between about 155 and 171 g/l (81.69–90.12 oz/gal), the preferred concentration being about 165 g/l (86.96 oz/gal). Boric acid is present in an amount sufficient to saturate the solution. The pH of the solution is adjusted with fluoboric acid to between about 0.1 and 0.6, the preferred pH being about 0.5.

The following examples indicates the limitations of the prior art.

EXAMPLE I

An electroplating solution was made up of 75.91 g/l (40 oz/gal) nickel fluoborate, $Ni(BF_4)_2$, and 29.96 g/l (4 oz/gal) free boric acid, $H_3BO_3$. The pH of the solution was adjusted to between 2.7 and 3.5 with fluoboric acid, $HBF_4$. A one-foot length of 0.060 in (0.13 cm) diameter steel wire was immersed in the solution for six seconds ( a plating rate of 10 ft/min or 5 cm/sec) at a current of 80 amps at 9.84 volts and a temperature between about 38 and 77 degrees Centigrade (100°–170° F.). Normal current densities used for plating nickel on steel are in the range of 25 to 200 amps per square foot. The limiting factor is the availability of nickel ions in solution in the vicinity of the wire. The resulting deposit was powdery with very poor adherence and was about 0.0005 inches (0.0013 cm) thick.

To compare with Example I, the following non-limiting example is presented.

EXAMPLE II

An electroplating solution in accordance with one aspect of the invention was made up of 165 g/l (86.96 oz/gal) nickel fluoborate and 396.93 g/l (53 oz/gal) free boric acid. The pH of the solution was adjusted to 0.5 with fluroboric acid. A one-foot length of 0.060 in (0.13 cm) diameter steel wire was immersed into the solution in a specialized high current density continuous wire plating cell for six seconds. The wire was plated at a current of 200 amps at 12.5 volts and a temperature between about 82 to 93 degrees Centigrade (180°–200° F.). The current density achieved in this example was 12,700 amps per square foot. The deposit achieved was smooth, adherent and ductile and was about 0.00125 inches (0.00318 cm) thick. A preferred temperature is 88 degrees centigrade.

In another example, a current density of 14,500 amps per square foot was obtained with similar results before the wire substrate began to overheat.

While there has been shown and described what are at present considered the preferred embodiments of the invention, it will be obvious to those skilled in the art that various changes and modifications may be made therein without departing from the scope of the invention as defined by the appended claims.

What is claimed is:

1. A bath for the electrodeposition of ductile nickel plate onto a wire substrate, said bath consisting essentially of: an aqueous acidic nickel plating solution consisting essentially of nickel fluoborate, wherein the concentration of said nickel fluoborate is between about 155 and 171 grams/liter; borice acid in an amount sufficient to saturate said solution; and fluoboric acid in an amount sufficient to adjust the pH of said solution to between about 0.1 and 0.6.

2. A bath as in claim 1 wherein said nickel fluoborate concentration is 165 grams/liter.

3. A bath as in claim 1 wherein said pH is about 0.5.

4. A method for plating nickel onto a wire substrate using a high speed, high current density continuous wire plating cell, said method comprising the steps of:

(a) forming a bath consisting essentially of an aqueous acidic nickel plating solution consisting essentially of: nickel fluoborate, wherein the concentration of said nickel fluoborate is between about 155 and 171 grams/liter; boric acid in an amount sufficient to saturate said solution; and fluoboric acid in an amount sufficient to adjust the pH of said solution to between about 0.1 and 0.6;

(b) heating said solution to between about 82° C. and 93° ;

(c) passing said wire substrate through said solution at a current density of at least 200 amps per square foot to obtain a smooth, ductile nickel plating on said wire substrate.

5. A method for plating nickel onto a wire substrate using a high speed, high current density continuous wire plating cell as in claim 4 wherein said concentration of said nickel fluoborate is about 165 grams/liter.

6. A method for plating nickel onto a wire substrate using a high speed, high current density continuous wire plating cell as in claim 4 wherein said pH is about 0.5.

7. A method for plating nickel onto a wire substrate using a high speed, high current density continuous wire plating cell as in claim 4 wherein said solution is heated to about 88° C.

8. A method for plating nickel onto a wire substrate using a high speed, high current density continuous wire plating cell as in claim 4 wherein said wire substrate is passed through said solution at a current density of at least 10,000 amps per square foot.

* * * * *